United States Patent [19]

York

[11] Patent Number: 5,015,011

[45] Date of Patent: May 14, 1991

[54] BINDER WITH OBSERVATION WINDOW

[75] Inventor: Brian K. York, Beavercreek, Ohio

[73] Assignee: The Mead Corporation, Dayton, Ohio

[21] Appl. No.: 555,959

[22] Filed: Jul. 23, 1990

[51] Int. Cl.[5] ..... B42D 3/00

[52] U.S. Cl. ..... 281/18; 281/15.1; 281/31; 281/51

[58] Field of Search ..... 281/18, 15.1, 31, 51; 40/124.1, 530; 229/1.5 R, 71

[56] References Cited

U.S. PATENT DOCUMENTS

| | | | |
|---|---|---|---|
| D. 302,698 | 8/1989 | Rexroat et al. . | |
| 2,477,840 | 8/1949 | Vasilas | 281/31 |
| 2,801,115 | 7/1957 | Federbush et al. | 281/31 |
| 3,174,244 | 3/1965 | Walton | 40/124.1 |
| 3,310,321 | 3/1967 | Freund | 281/31 |
| 3,545,115 | 12/1970 | Nichols | 40/124.1 |
| 4,630,843 | 12/1986 | Willat | 281/31 |
| 4,779,791 | 10/1988 | Wyant | 229/1.5 |
| 4,832,369 | 5/1989 | Johnson et al. | 281/18 |
| 4,838,724 | 6/1989 | Spence, Jr. | 281/31 |
| 4,848,798 | 7/1989 | Moor | 281/29 |
| 4,934,584 | 6/1990 | Wyant | 229/72 |

*Primary Examiner*—Hien H. Phan
*Assistant Examiner*—Hwei-Siu Payer
*Attorney, Agent, or Firm*—Biebel, French & Nauman

[57] ABSTRACT

A binder having an observation window characterized by a bubble structure. The window is constructed inside an aperture which is die cut into a support board. Transparent cover sheets are depressed into the aperture and heat-sealed together along a relatively narrow track adjacent the edge of the panel aperture. A bubble is defined by an air pocket formed interiorly of the sealing boundary.

10 Claims, 3 Drawing Sheets

10
26
12
32
30
32
22
34
24

BINDER WITH OBSERVATION WINDOW

BACKGROUND OF THE INVENTION

This invention relates to a binder having an observation window which students, and particularly those of a younger age, will find to be useful and attractive. Young students purchase or create a purchasing demand for large quantities of school-related products which meet utilitarian needs while being appealing to the eye. Moreover, the demands of such customers have spurred a creative response resulting in a flood of new school-related products, particularly in the field of binders and portfolios. These products provide the youthful customer with an opportunity to make an identity statement by carrying school papers in a distinctive product of his or her choosing. Examples of such products are disclosed in a series of patents and patent applications assigned to the assignee hereof. They include: Wyant U.S. Pat. No. 4,779,791 which discloses a portfolio having a decorative woven fabric cover sheet, Spence U.S. Pat. No. 4,838,724 which relates to a binder with a pencil pocket and Moor U.S. Pat. No. 4,848,798 which discloses a binder having a decoratively perforated interior pocket, Wyant U.S. patent application Ser. No. 357,917 filed May 30, 1989 showing a portfolio with a mirrorized cover, Wyant U.S. patent application Ser. No. 379,306 disclosing a portfolio having a cover provided with a plurality of decoratively arranged window mounts for personal photographs and Moor, U.S. patent application Ser. No. 356,152 filed May 24, 1989 disclosing a binder having decoratively die-cut support panels covered by thermoplastic sheets which are heat-sealed into the die-cut portions to create a three-dimensional effect.

SUMMARY OF THE INVENTION

This invention provides an improved binder having a cover panel defined by a stiff support board covered on both sides by transparent thermoplastic sheets. The support board is provided with a window aperture, and the transparent thermoplastic sheets are joined together inside the aperture to define an observation window. In one aspect of the invention the thermoplastic sheets are heat-sealed together along a relatively narrow track interiorly adjacent the perimeter of the aperture and a pocket of air is trapped interiorly of the track so as to produce an observation window having a bubble structure.

It is therefore an object of the invention to provide a binder having an observation window for viewing the contents thereof.

It is another object of the invention to provide a binder having a unique decorative appearance.

Other objects and advantages of the invention will be apparent from the following description, the accompanying drawings and the appended claims.

DESCRIPTION OF THE PREFERRED EMBODIMENT

Figure 1:
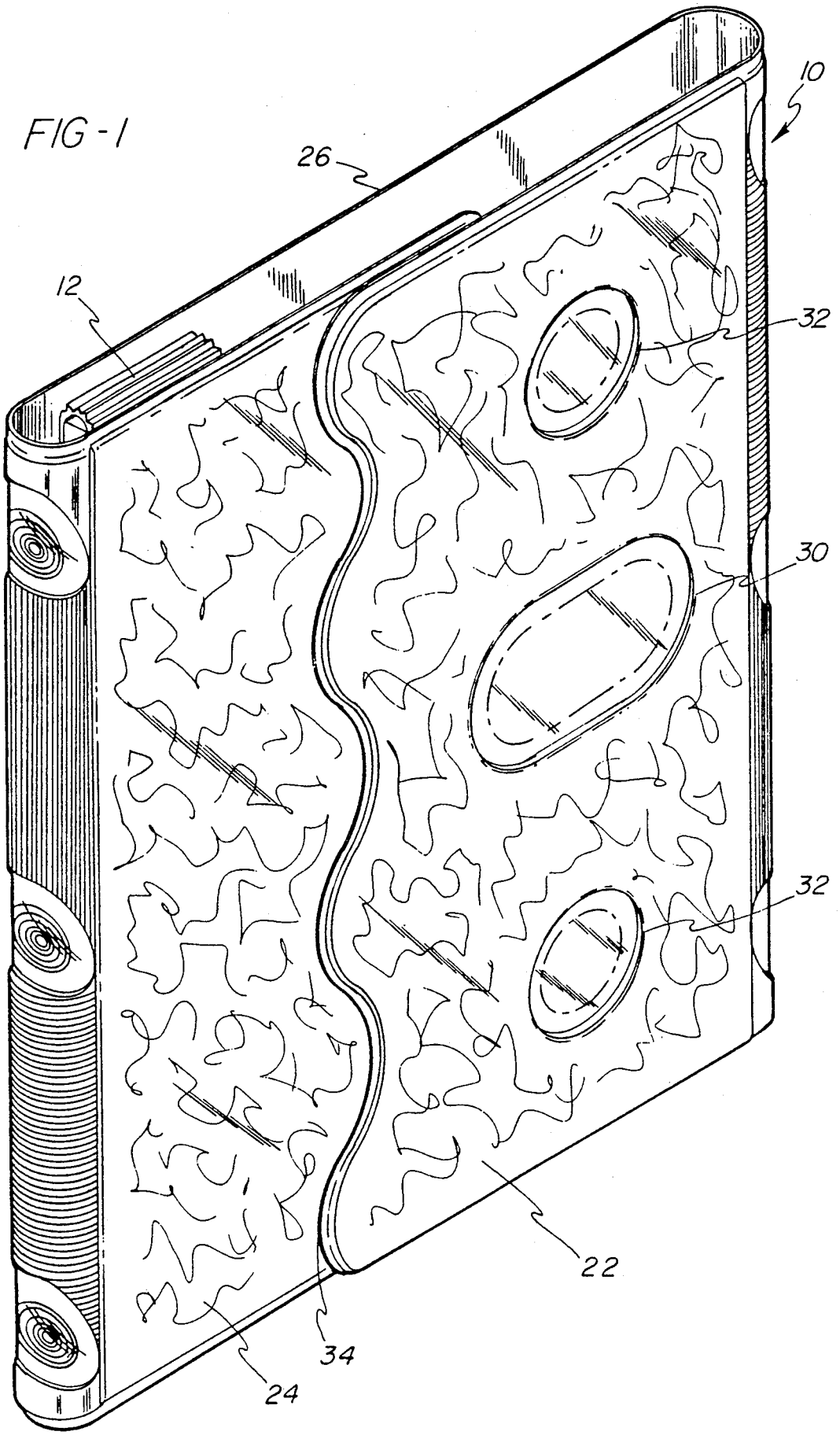
FIG. 1 is a perspective view of a binder having an oblong observation window and two circular observation windows in the outer panel thereof.

In preferred embodiment a binder 10 according to the present invention may appear as generally illustrated in FIG. 1. The illustrated embodiment includes an outer panel 22 overlapped against an inner panel 24. The visual appearance of outer panel 22 may be enhanced by a scalloped edge as indicated by the reference numeral 34. Outer panel 22 also may be provided with one or more observation windows such as an oblong window 30 and a pair of circular windows 32,32. A rear panel 26 joins and connects panels 22 and 24.

Figure 2:
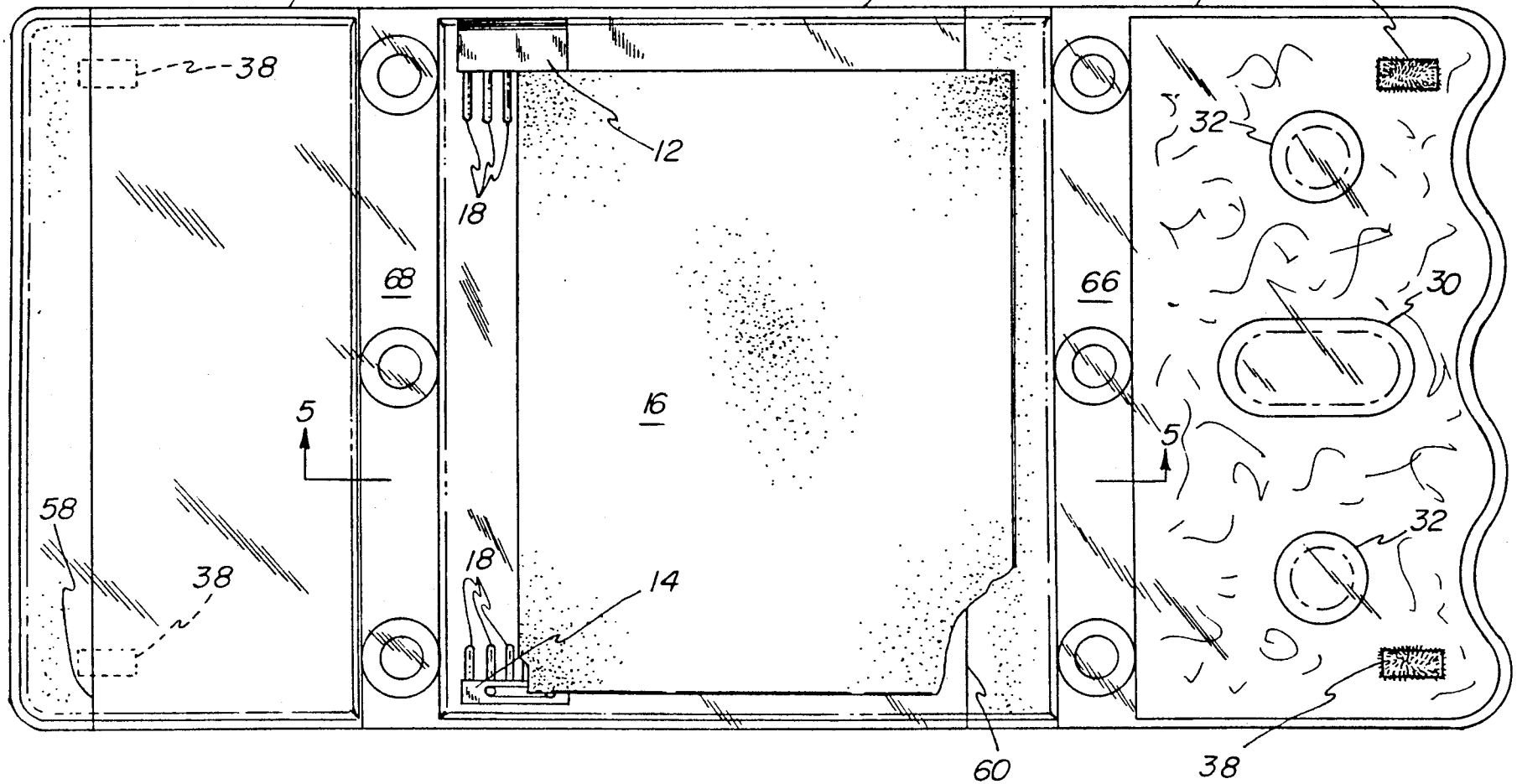
FIG. 2 is a horizontal plan view of the binder of FIG. 1 in the opened condition.

The interior of binder 10 is illustrated in FIG. 2, as shown therein binder 10 may retain one or more leaves 16 by a suitable retaining device such as, for instance, a pair of spaced brackets 12,14, each having a plurality of spaced prongs 18. The illustrated retaining device is constructed as generally taught in Donovan U.S. Pat. No. 4,659,109, to which reference may be made for a full understanding thereof. However, snap rings or other retaining devices may be employed.

Figure 3:
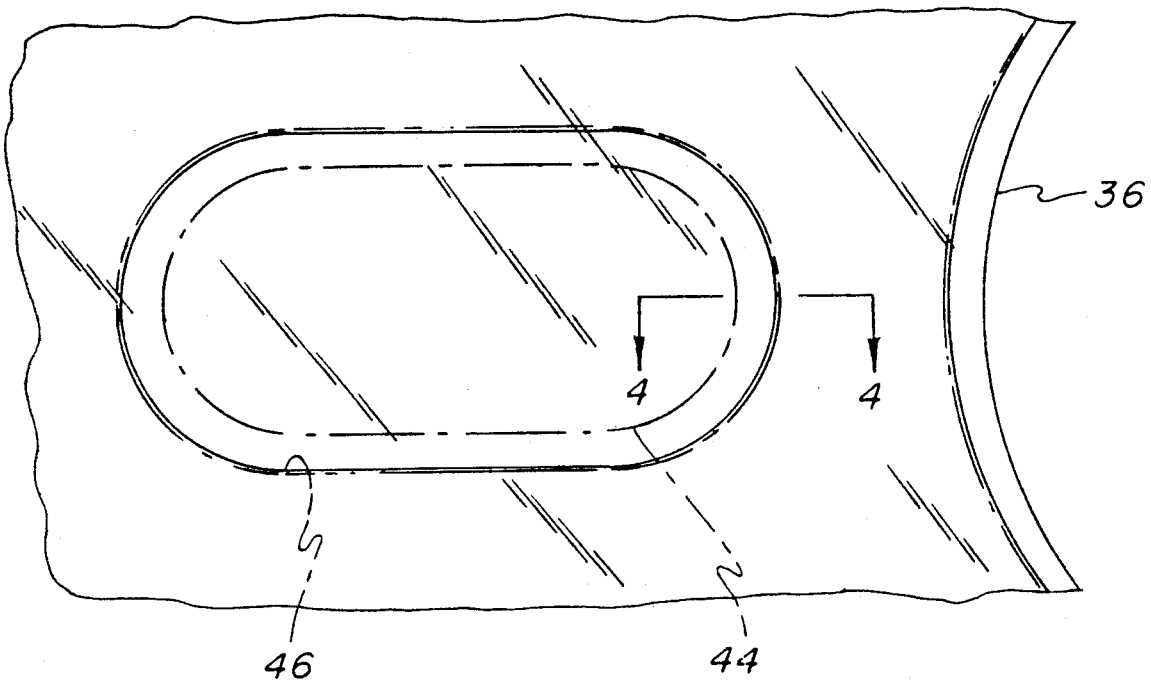
FIG. 3 is an enlarged drawing of a portion of FIG. 2.
Figure 5:
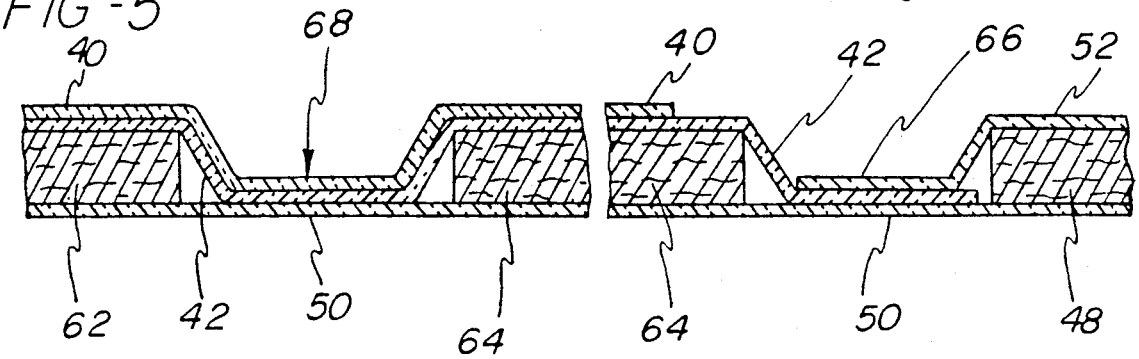
FIG. 5 is a cross-sectional view taken along lines 5—5 of FIG. 2.

As best illustrated in FIG. 5, panels 22,24,26 are supported by support boards 48,64,62 respectively. Support boards 48,64,62 may be produced by die-cutting sheets of chipboard. These support boards may be imprinted on their outer surfaces by attractive graphic designs and may be overlaid by a transparent vinyl outer sheet 50 which allows the printed graphics to be observed. Outer panel support board 48 may also be printed with an attractive graphic pattern on its inwardly facing surface and may be overlaid by a transparent vinyl inner sheet 52. An opaque vinyl liner sheet 42 may cover the inner surfaces of support boards 64,62. Vinyl sheets 52,50,42 are heat-sealed together in regions of overlap, including the outer perimeter 36 (FIG. 3). A vinyl pocket sheet 40 may be overlaid upon liner sheet 42 and sealed along the marginal edges to define a pair of pockets which are open along edges 58,60 thereof. The joined vinyl sheets define a first hinge portion 66 and a second hinge portion 68 in the regions between the support boards. Four strips of hook-and-loop fastening material 38 are provided for releasibly securing the inner surface of outer panel 22 against the outer surface of inner panel 24.

Figure 4:
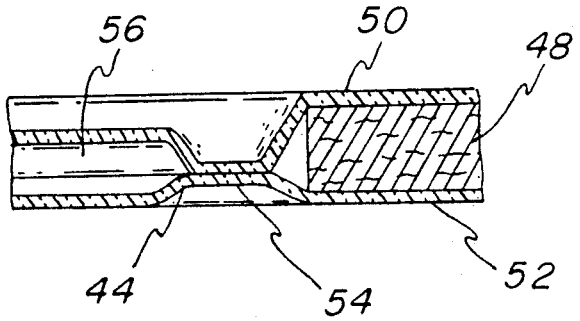
FIG. 4 is a cross-sectional view taken along lines 4—4 of FIG. 3.

The details of one of the observation windows 30 are illustrated in FIGS. 3 and 4. The windows are constructed inside a large aperture 46 which is die cut into outer panel support board 48. Transparent cover sheets 50,52 are depressed into the aperture and heat-sealed together along a relatively narrow track 54 generally defined by the region between aperture 46 and a sealing boundary 44. When the transparent sheets 50,52 are depressed into the aperture and sealed along the track 54, an air pocket 56 is formed interiorly of the sealing boundary 44. This provides structural integrity and an attractive appearance to the window. It will be appreciated that windows 30,32 provide the useful function of enabling a view of the contents of binder 10. They also create a decorative effect which makes the binder particularly appealing to the customers for whom it is intended.

While the product described herein constitutes a preferred embodiment of the invention, it is to be understood that the invention is not limited to this precise product, and that changes may be made therein without departing from the scope of the invention which is defined in the appended claims.

What is claimed is:

1. A binder comprising:

a transparent thermoplastic outer sheet;

a rear panel support board centrally positioned on said outer sheet;

an outer panel support board positioned on said outer sheet facing said rear panel support board and spaced therefrom to define a first hinge portion;

an inner panel support board positioned on said outer sheet facing said rear panel support board opposite said outer panel support board and spaced apart from said rear panel support board to define a second hinge portion;

a transparent thermoplastic inner sheet covering said outer panel support board opposite said outer sheet to define an outer panel depending from said first hinge portion;

thermoplastic liner sheet means covering said rear panel support board and said inner panel support broad to define a rear panel and an inner panel joined along said second hinge portion;

binding means mounted interiorly of said binder;

said inner panel and said outer panel being of sufficient length for covering materials retained by said binding means;

said outer panel board being provided with a window aperture and said inner sheet and said outer sheet being joined together inside said aperture to define an observation window.

2. A binder according to claim 1 wherein said inner sheet and said outer sheet are heat-sealed together along a relatively narrow track interiorly adjacent the perimeter of said aperture; a pocket of air being trapped interiorly of said tract to produce a bubble structure within said window.

3. A binder according to claim 1 wherein said outer panel and said inner panel are of sufficient length for relative overlapping.

4. A binder according to claim 3 further comprising fastening means for releasibly securing said outer panel to said inner panel.

5. A binder according to claim 4 wherein said fastening means comprises a first strip of fabric fastener material adhered to said outer panel on the side thereof which is covered by said inner sheet and a second strip of fabric fastener material adhered to said inner panel on the side thereof which is covered by said outer sheet, said strips being positioned for mutual fastening engagement when said outer panel is folded exteriorly against said inner panel.

6. A binder according to claim 1 further comprising a pocket sheet covering said line sheet means and marginally secured thereto for defining a rear panel pocket and an inner panel pocket.

7. A binder according to claim 1 wherein the surfaces of said inner panel support board and said outer panel support board which face said outer sheet are imprinted with graphic designs.

8. A binder according to claim 7 wherein all three of said support boards are imprinted with graphic designs on those of their surfaces which face said outer sheet and said outer panel support board is additionally imprinted with a graphic design on the surface thereof which faces said inner sheet.

9. In a binder comprising a cover panel defined by a stiff support board covered on opposite faces by a thermoplastic outer sheet and a thermoplastic inner sheet, the improvement wherein said support board is provided with a window aperture and said inner sheet and said outer sheet are transparent and are heat-sealed together along a relatively narrow track interiorly adjacent the perimeter of said aperture; a pocket of air being trapped interiorly of said track to produce an observation window having a bubble structure.

10. The improvement of claim 9 wherein said observation window has an oval shape and is flanked by two other observation windows of like cross-sectional construction as said first named observation window and characterized by circular configurations.

* * * * *